United States Patent [19]

Yoshimitsu

[11] 4,168,737

[45] Sep. 25, 1979

[54] HEAT EXCHANGE RECUPERATOR

[75] Inventor: Toshio Yoshimitsu, Fujisawa, Japan

[73] Assignee: Kabushiki Kaisha Komatsu Seisakusho, Tokyo, Japan

[21] Appl. No.: 852,787

[22] Filed: Nov. 18, 1977

[30] Foreign Application Priority Data

Nov. 19, 1976 [JP] Japan ..... 51-154503[U]
Nov. 19, 1976 [JP] Japan ..... 51-154504[U]

[51] Int. Cl.[2] ..... F28F 19/00

[52] U.S. Cl. ..... 165/76; 165/134 R; 165/159; 165/165; 165/DIG. 2; 237/55

[58] Field of Search ..... 165/76, 134, 174, DIG. 2, 165/159, 160, 161, 165, 166, 167; 237/55

[56] References Cited

U.S. PATENT DOCUMENTS

| | | | |
|---|---|---|---|
| 1,451,871 | 4/1923 | Fowler | 165/134 |
| 2,024,496 | 12/1935 | Young | 165/134 |
| 2,646,818 | 7/1953 | Bimpson | 165/134 |
| 2,902,264 | 9/1959 | Schick et al. | 165/134 |
| 3,078,919 | 2/1963 | Brown, Jr. | 165/134 |
| 3,149,667 | 9/1964 | Astrup | 165/134 |
| 3,190,352 | 6/1965 | Simpelaar | 165/134 |
| 3,568,763 | 3/1971 | Stoker et al. | 165/134 |
| 4,079,781 | 3/1978 | Wesseltoft | 165/76 |

FOREIGN PATENT DOCUMENTS

| | | | |
|---|---|---|---|
| 590876 | 12/1933 | Fed. Rep. of Germany | 165/134 |
| 902849 | 9/1945 | France | 165/134 |

*Primary Examiner*—Sheldon Jay Richter
*Attorney, Agent, or Firm*—Armstrong, Nikaido, Marmelstein & Kubovcik

[57] ABSTRACT

A heat exchange recuperator comprising a box-like housing having inlets and outlets for heating gases and gases to be heated, respectively, connecting plates mounted on a lower and an upper walls of said housing, and a plurality of hollow metallic plates disposed in spaced relation sandwiched by said connecting plates. The heating gases are adapted to pass through the spaces between said hollow plates and the gases to be heated are adapted to pass through said hollow plates. A plurality of generally U-shaped heat-resisting cover plates are detachably mounted on the upstream ends, with respect to the heating gases, of said each hollow plates, respectively, with defining spaces between the upstream ends of said hollow plates and inner walls of said cover plates.

1 Claim, 3 Drawing Figures

HEAT EXCHANGE RECUPERATOR

BACKGROUND OF THE INVENTION

This invention relates to heat exchangers, and more particularly to recuperators in which hot gases such as exhaust gases of combustion or flue gases are used to preheat air or fluid fuel to be used in combustion.

In recent years the greatly increased costs of fuel, labor and capital equipment have made it important to recover as much heat as possible from flue gases and transfer it to the incoming combustion air in order to increase the heating efficiency. It is also important that furnace shutdowns for maintenance, such as for repair or replacement of recuperators, be reduced to a minimum. While new furnace installations are designed and built with these factors in mind, great efforts are also being made to increase the efficiency and outputs of existing furnaces because of high costs of new furnaces and long times required to build and put them into operation; and increased recovery of otherwise wasted heat in flue gases is one of the most effective and economical approaches toward achieving increases in efficiency and output of old furnaces.

For these reasons it is desired that recuperators employed not only provide high recovery of heat from flue gases, but also have long service lives with a minimum of maintenance and furnace shut-down. This, however, is exceedingly difficult to achieve because of the extremely rigorous service conditions to which the recuperator heat exchange elements are subjected in operation.

In recuperators of the general type in connection with which this invention provides particular advantages, i.e. metallic recuperators having hollow plate type heat exchange elements, the heat exchange elements are exposed to hot waste or flue gases which often are at such high temperatures that they are incandescent, and which usually have high velocities. The high temperatures alone have deteriorating effects on the metal of the outer walls of the heat exchange elements; and the relatively high velocities of the hot gases also tend to harmfully affect the metal by erosion tendencies. The flue gases also contain constituents which tend to corrode or cause other deleterious chemical or metallurgical reactions on such metal, and this action is promoted by the high gas temperatures and velocities.

In the heat exchange elements these harmful effects occur to the greatest extent on the portions of the outer walls of the heat exchange elements facing the flow of hot flue gases.

SUMMARY OF THE INVENTION

It is therefore an object of the present invention to provide a heat exchange recuperator having metallic heat exchange elements in which the heat exchange elements may be used at higher temperatures than otherwise possible, with longer service life and a minimum of furnace shutdowns for repair of preventative inspections.

Another object of the present invention is to provide a heat exchange recuperator having metallic heat exchange hollow plates of which the front portions of the outer hollow plate walls facing the hot flue gases are provided with shielding members which generally reduce or prevent overheating, excessive corrosion, or deterioration of such hollow plate wall portions.

In accordance with an aspect of the present invention, there is provided a heat exchange recuperator comprising a box-like housing having an inlet and an outlet for heating gases formed in side walls of said housing, said inlet and outlet being opposed with each other, said box-like housing also having an inlet and an outlet for gases to be heated formed in lower and upper walls thereof, respectively. A pair of connecting plates are mounted on said lower and upper walls of said box-like housing, respectively, said connecting plates having a plurality of holes formed therein, and a plurality of hollow metallic plates are disposed in spaced relation sandwiched by said connecting plates, both ends of said hollow metallic plates being inserted into the holes of said connecting plates. The heating gases are adapted to pass through the spaces between said hollow metallic plates and the gases to be heated are adapted to pass through said hollow metallic plates. In order to protect the front portions of the outer hollow metallic plate walls facing the hot flue gases, a plurality of generally U-shaped heat-resisting cover plates are detachably mounted thereon, respectively, with defining spaces between the front portions of said outer hollow metallic plate walls and inner walls of said cover plates. Because the U-shaped heat-resisting cover plates are mounted to the front portions of said outer hollow metallic plate walls with enclosed spacings having both side ends being opened, the front portions of said hollow metallic plates are substantially insulated from high temperatures of the flue gases and being hit by consituents with relatively high velocities contained in the flue gases.

A plurality of buffer bars are detachably mounted to said box-like housing upstream to said hollow metallic plates, said buffer bars being adapted to contact to said U-shaped cover plates so as to prevent the latter from being slipped off from said hollow metallic plates.

Since both said U-shaped heat-resisting cover plates and buffer bars are detachably mounted, repair and replacement thereof can easily be performed.

The above and other objects, features and advantages of the present invention will be readily apparent from the following description taken in conjunction with the accompanying drawings.

DETAILED DESCRIPTION OF THE INVENTION

Figure 1:
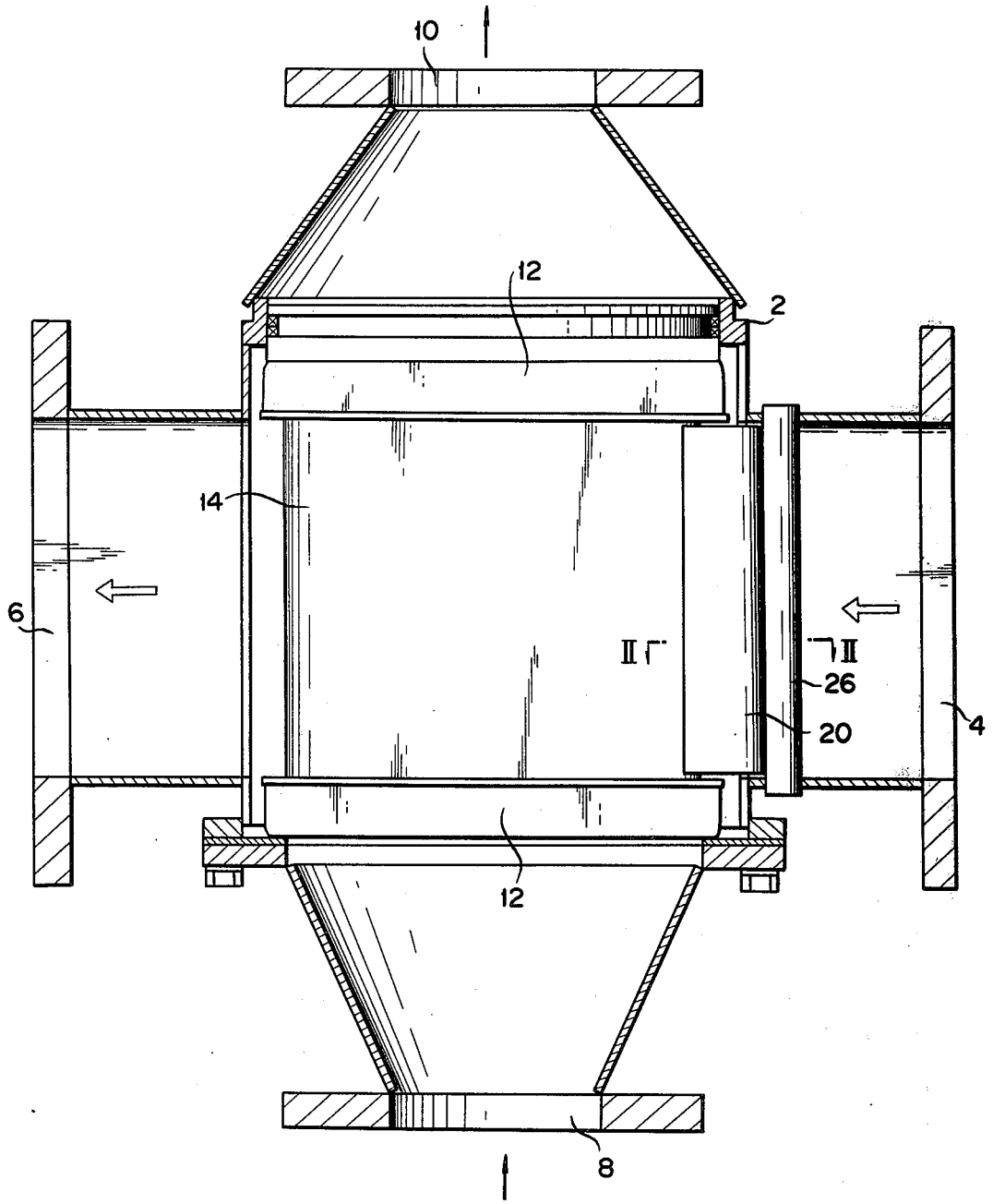
FIG. 1 is a longitudinal cross-sectional view of a heat exchange recuperator according to the present invention.

The present invention will now be described with reference to the accompanying drawings. Referring to FIG. 1, reference numeral 2 denotes a box-like housing for the heat exchange recuperator having an inlet 4 for the heating gases or flue gases exhausted from a furnace not shown formed in one side wall thereof and an outlet 6 for the flue gases formed in the opposite side wall thereof. The box-like housing 2 also has an inlet 8 for the gases to be heated formed in the lower wall thereof and an outlet 10 for the gases after heat exchanged formed in the upper wall thereof.

The outlet 6 for the heating gases is connected to a flue not shown and the inlet 8 for the gases to be heated is connected to a blower not shown while the outlet 10 thereof is connected to a burner not shown. A pair of connecting plates 12 are mounted on the lower and upper walls of the housing 2, respectively. A plurality of holes are formed in spaced relation in the connecting plates 12. A plurality of hollow metallic heat exchange plates 14 are mounted in spaced relation in the housing 2 sandwiched by the connecting plates 12 with lower and upper ends thereof being inserted in the holes of the connecting plates 12.

The hollow-metallic plates 14 have openings at their lower and upper ends but their side walls being closed so that the gases to be heated are adapted to pass through inside of the hollow metallic plates 14 in vertical direction.

Figure 2:
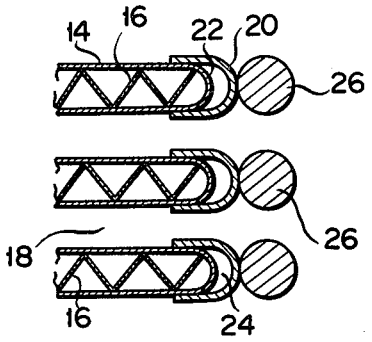
FIG. 2 is a view taken along the line II—II of FIG. 1 showing the front portions of the hollow metallic heat exchange plates provided with U-shaped cover plates.

Referring to FIG. 2, a wave-like fin 16 is disposed within the each hollow metallic plate 14 in vertical direction. The flue gases or heating gases are adapted to pass through spaces 18 formed between the each hollow metallic heat exchange plate 14. Generally U-shaped heat-resisting cover plates 20 are detachably mounted on the front portions 22 of the outer hollow metallic plate walls facing the hot flue gases, respectively, with defining spaces 24 between the front portions 22 of the outer hollow metallic plate walls and inner walls of the U-shaped heat-resisting cover plates 20. The U-shaped heat-resisting cover plates 20 are preferably formed of a suitable heat-resisting material, such as a heat-resisting metal alloy or metal covered with a layer of heat-resisting material, or they may be entirely formed of a heat-resisting non-metallic material such as ceramic material.

A plurality of buffer bars 26 are mounted vertically in front of and in parallel to the each U-shaped heat-resisting cover plates 20, respectively. The outer periphery of the each buffer bars 26 contacts with the each U-shaped heat-resisting cover plates 20 thereby preventing the latter from being slipped off from the each hollow metallic plates 14.

The buffer bars 26 are preferably made of heat-resisting materials such as heat-resisting metal alloys or metals covered with a layer of heat-resisting materials. The buffer bars 26 are detachably mounted or fixedly secured at one ends thereof with the other ends being left free to the box-like housing 2. In the case of one end fixing embodiment, since the other end of the baffer bar 26 is left free, thermal stresses are hardly produced within the buffer bar 26 when it is exposed to an elevated temperature.

The buffer bars 26 serve not only to prevent the U-shaped cover plates 20 from being slipped off from the hollow metallic heat exchange plates 14 but also to enhance the insulation of the front portions 22 of the outer hollow metallic plate walls from being exposed to elevated temperatures.

Figure 3:
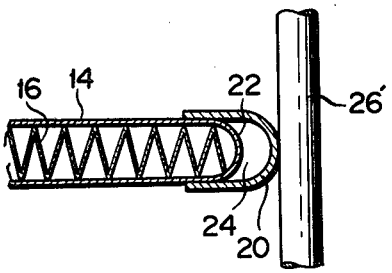
FIG. 3 is similar to FIG. 2 but showing the buffer bars being mounted at right angles relative to said hollow metallic plates.

Referring to FIG. 3, buffer bars 26' are detachably mounted at right angles relative to the hollow metallic heat exchange plates 14 contacting the outer periphery thereof with the U-shaped heat-resisting cover plates 20. The baffer bars 26' in this embodiment is only to prevent the U-shaped cover plates 20 from being slipped off from the hollow metallic heat exchange plates 14.

Since the heat exchange recuperator of the present invention is constructed as described hereinabove, the front portions 22 of the hollow metallic heat exchange plates 14 are substantially insulated from elevated temperatures of the flue gases and being hit by constituents with relatively high velocities contained in the flue gases.

While the heat exchange recuperator in accordance with the present invention has been shown and described in terms of its specific forms, it is understood that the invention itself is not to be restricted by the exact details of this disclosure.

Numeral modifications or changes will readily occur to those skilled in the art without departing from the spirit or scope of the invention as sought to be defined by the following claims.

What is claimed is:

1. In a heat exchange recuperator including a box-like housing having an inlet and outlet for heating gases formed in the side walls of said housing, respectively, said inlet and outlet being opposed to each other, said box-like housing also having an inlet and an outlet for gases to be heated formed in lower and upper walls thereof, respectively, a pair of connecting plates mounted on said lower and upper walls of said box-like housing, respectively, said connecting plates having a plurality of holes formed therein, and a plurality of heat exchange hollow plates disposed in spaced relation sandwiched by said connecting plates, both ends of said hollow plates being inserted into the holes of said connecting plates, wherein the heating gases are adapted to pass through the spaces between said hollow plates and the gases to be heated are adapted to pass through inside of said hollow plates; the improvement comprising a plurality of generally U-shaped heat-resisting cover plates detachably mounted on the upstream ends, with respect to the heating gases, of each of said hollow plates, respectively, wherein spaces are formed between the upstream ends of said hollow plates and inner walls of said cover plates, and a plurality of buffer bar means detachably mounted to said box-like housing upstream, in parallel and opposed to said cover plates, said buffer bar means being adapted to contact with said U-shaped cover plates so as to prevent said cover plates from slipping off from said hollow plates and to insulate said U-shaped cover plates.

* * * * *